US009326328B2

(12) United States Patent
Corleoni et al.

(10) Patent No.: US 9,326,328 B2
(45) Date of Patent: Apr. 26, 2016

(54) INDUCTION COOKING HOB WITH ILLUMINATION EQUIPMENT

(75) Inventors: Fransesco Corleoni, Meldola (IT); Fabienne Reinhard-Herrscher, Gerabronn (DE); Filippo Tisselli, Forlimpopoli (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 438 days.

(21) Appl. No.: 13/641,940

(22) PCT Filed: Jul. 8, 2011

(86) PCT No.: PCT/EP2011/003407

§ 371 (c)(1),
(2), (4) Date: Oct. 18, 2012

(87) PCT Pub. No.: WO2012/003991

PCT Pub. Date: Jan. 12, 2012

(65) Prior Publication Data

US 2013/0098901 A1 Apr. 25, 2013

(30) Foreign Application Priority Data

Jul. 9, 2010 (EP) ..... 10007089

(51) Int. Cl.
*H05B 6/12* (2006.01)
*H05B 6/02* (2006.01)

(52) U.S. Cl.
CPC .. *H05B 6/02* (2013.01); *H05B 6/12* (2013.01); *H05B 6/1218* (2013.01)

(58) Field of Classification Search
CPC ..... H05B 6/02; H05B 6/12; H05B 6/1218
USPC ..... 219/620–627
See application file for complete search history.

(56) References Cited

U.S. PATENT DOCUMENTS 6,369,365 B1 * 4/2002 Nass et al. ..... 219/445.1
7,041,945 B2 * 5/2006 Aihara et al. ..... 219/622

(Continued)

FOREIGN PATENT DOCUMENTS

| | | |
|---|---|---|
| EP | 0482854 | 4/1992 |
| EP | 1250028 | 10/2002 |
| JP | 3114183 | 5/1991 |
| JP | 3289086 | 12/1991 |
| JP | 2003257601 | 9/2003 |

OTHER PUBLICATIONS

English machine translation of JP2003-257601 Sep. 2003.*

(Continued)

*Primary Examiner* — Sang Y Paik
(74) *Attorney, Agent, or Firm* — Pearne & Gordon LLP

(57) ABSTRACT

The present invention relates to an induction cooking hob with illuminating equipment. The induction cooking hob includes a panel (10) arranged at the top side of said induction cooking hob, and a chassis (12) forming a substructure of said induction cooking hob. The panel (10) comprises at least one heating zone (14). The chassis (12) comprises at least one induction coil (16). The heating zone (14) corresponds with at least one induction coil (16). The induction cooking hob includes at least one intermediate layer (18, 20) between the panel (10) and the chassis (12). The intermediate layer (18) comprises a plurality of cut-outs (22) arranged according to a predetermined pattern within the heating zone (14). The chassis (12) comprises at least one light emitting diode (24) arranged in a central portion of the induction coil (16).

15 Claims, 2 Drawing Sheets

(56) References Cited

U.S. PATENT DOCUMENTS

Figure 1:
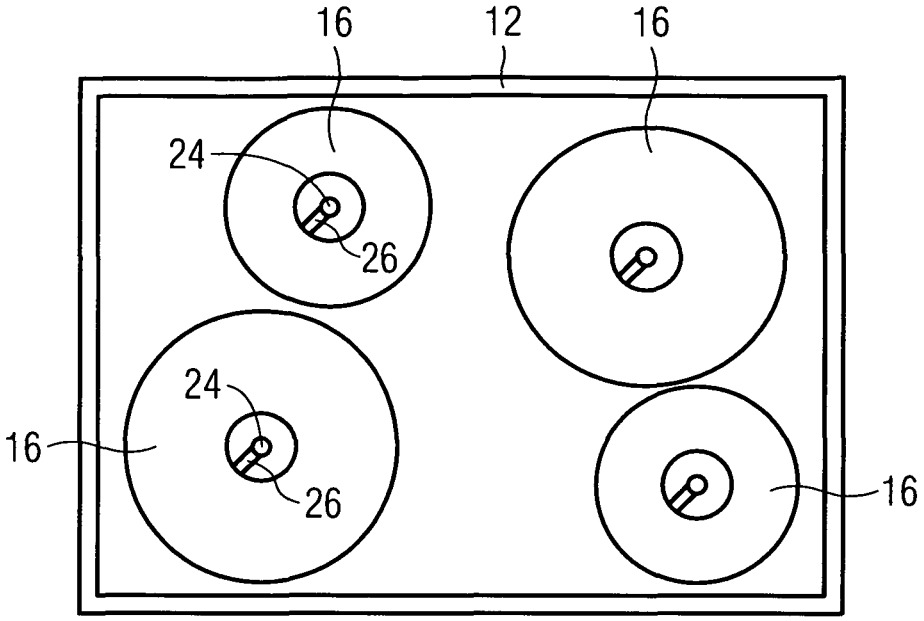

| | | | | |
|---|---|---|---|---|
| 8,058,589 | B2 * | 11/2011 | Cho | 219/448.17 |
| 2007/0295711 | A1 * | 12/2007 | Striegler et al. | 219/448.11 |
| 2008/0264931 | A1 * | 10/2008 | Vilato et al. | 219/622 |
| 2012/0118281 | A1 * | 5/2012 | Shigeoka et al. | 126/1 R |

OTHER PUBLICATIONS

English Translation of JP03-114183 of May 1991.*
International Search Report for PCT/EP2011/003407, dated Aug. 16, 2011, 2 pages.

* cited by examiner

INDUCTION COOKING HOB WITH ILLUMINATION EQUIPMENT

The present invention relates to an induction cooking hob with illumination equipment according to the preamble of claim 1.

On the induction cooking hob the heating elements, i.e. the inductions coils, are arranged within a chassis and below a panel of said induction cooking hob. The heating elements and the corresponding heating zones are not visible by the user. Thus, the user cannot see the positions and sizes of the heating zones. Further, since the inductions coils do not radiate any heat, the user cannot determine if the heating elements are activated or not.

In known induction cooking hobs with illumination equipment the light sources are installed in a very complex way. For example, light sources with reflectors are used below the panel of the induction cooking hob. In other solutions, illuminating rings made out of light guiding material or multiple single light emitting diodes enclose the heating zones.

It is an object of the present invention to provide an induction cooking hob with illumination equipment, which has low complexity and low cost of materials.

The object of the present invention is achieved by the induction cooking hob according to claim 1.

According to the present invention the intermediate layer between the induction coils and the stove top material comprises a plurality of cut-outs arranged according to a predetermined pattern within the heating zone, and the chassis comprises at least one light emitting diode arranged in a central portion of the induction coil, wherein the light emitting diode corresponds with at least one cut-out.

The main idea of the present invention is the arranging of the light emitting diode (LED) in the centre of the induction coil and the one or more corresponding cut-outs. This constellation allows an illumination of the heating zone on the induction cooking hob from below. The inventive induction cooking hob has a low complexity, since only the light emitting diode and a corresponding transmitting portion are required.

According to a preferred embodiment of the present invention the intermediate layer represents a printed layer applied at the lower side of the panel. The printed layer may be realized by low cost of materials.

Preferably, the printed layer is a dark coloured layer, in particular a black coloured layer. In this case, the cut-outs may be formed as blank portions of the printed layer. The dark or black coloured layer and the blank portions increase the contrast between the cut-outs and the remaining area of the panel. It should be noted, that this layer described in this context as printed, might be applied in any other feasible way.

Alternatively or additionally, the intermediate layer comprises or includes a sheet arranged between the panel and the chassis. In this case the positions of the cut-outs are independent of the panel. The panel can be designed independent of the sizes and positions of the heating zones.

In particular, the sheet is made of at least one dielectric material.

According to a preferred embodiment of the present invention the sheet is or comprises a mica layer. The mica layer is a sheet made of dielectric material.

Preferably, the cut-outs in the mica layer may be filled by a transparent dielectric material. For example, the cut-outs in the mica layer are filled by a foil or layer made of polyimide.

Further, the light emitting diode is fastened by a support element having low heat conductivity. Advantageously already present support elements are used, for example the support element of a temperature sensor. The support element may be used as an optical device and guide the light emitted by the LED more efficiently to the panel.

In particular, the cut-outs are shaped as slots, wherein said slots are arranged according to a predetermined pattern. For example the slots form a symbol.

Preferably, the panel is a glass ceramic panel.

Novel and inventive features of the present invention are set forth in the appended claims.

Figure 2:
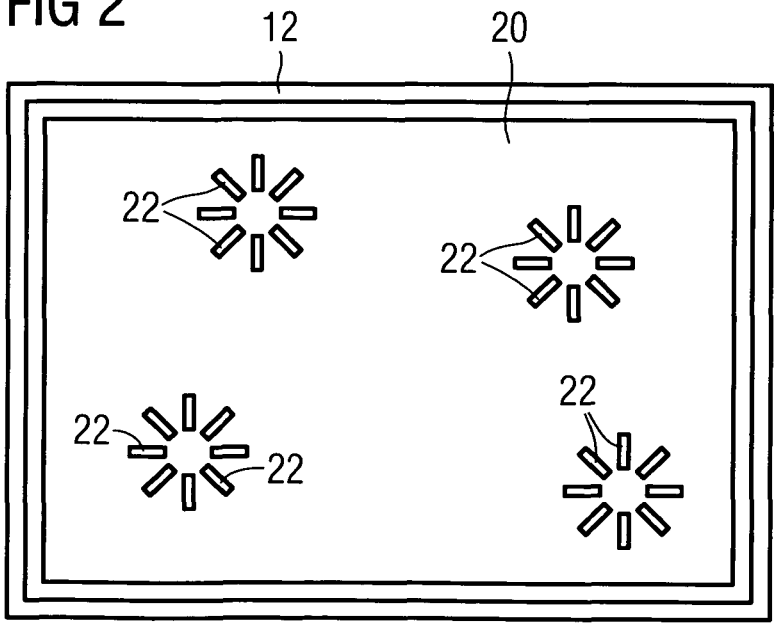
Figure 3:
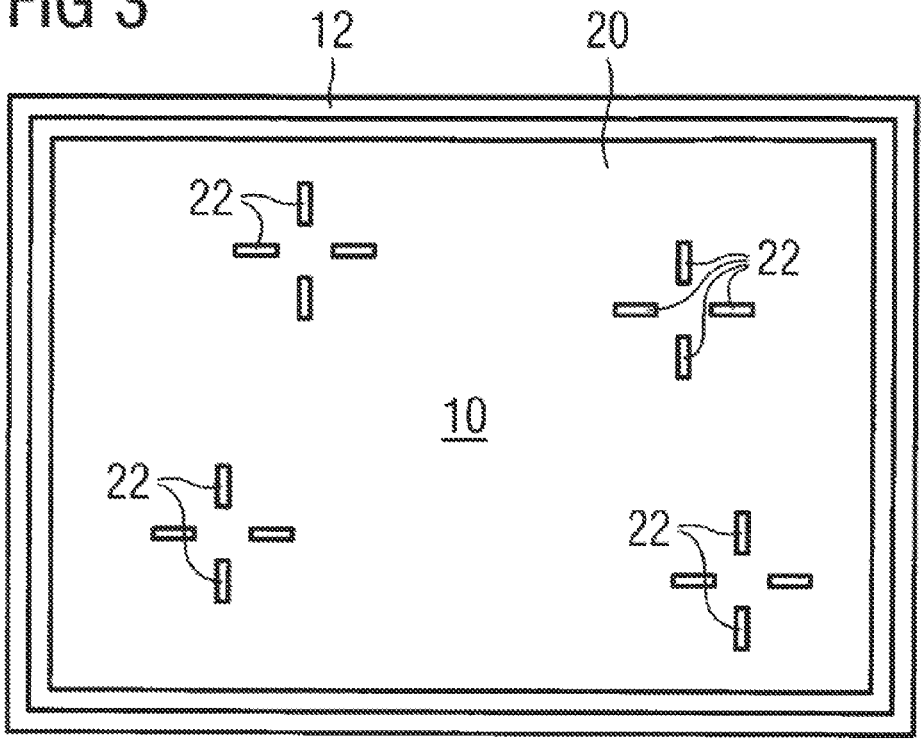
Figure 4:
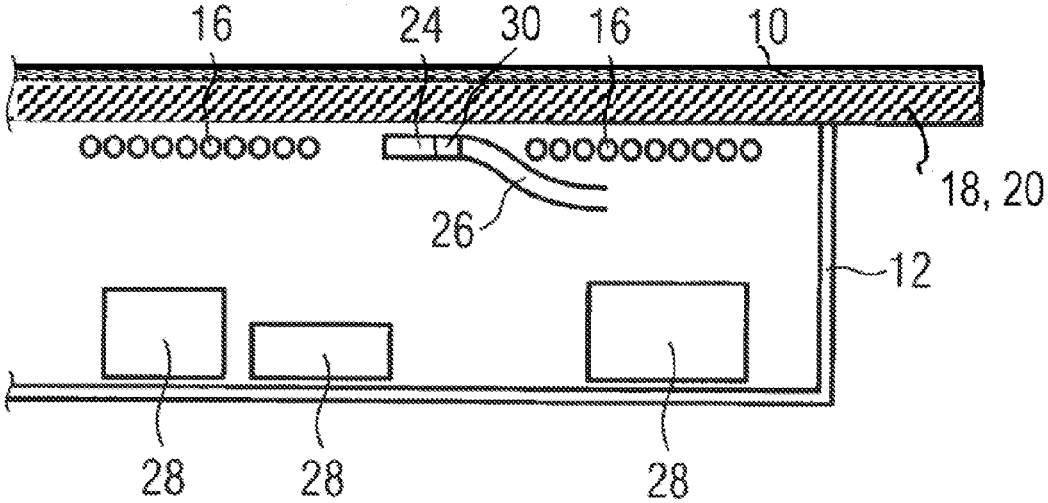

The present invention will be described in further detail with reference to the drawings, in which FIG. 1 illustrates a schematic top view of a chassis for an induction cooking hob according to a first embodiment of the present invention, FIG. 2 illustrates a schematic top view of the chassis for the induction cooking hob with a sheet according to the first embodiment of the present invention, FIG. 3 illustrates a schematic top view of the induction cooking hob with a panel according to a second embodiment of the present invention, and FIG. 4 illustrates a sectional partial side view of the induction cooking hob according to a third embodiment of the present invention.

FIG. 1 illustrates a schematic top view of a chassis 12 for an induction cooking hob according to a first embodiment of the present invention. The chassis 12 is open, wherein a panel 10 and a sheet 20 are missing.

The chassis 12 comprises four induction coils 16 arranged as a two-by-two matrix. The induction coils 16 are formed as circular disks. In the centre of each induction coil 16 there is a circular hole. The induction coils 16 have different sizes.

The chassis 12 comprises further electronic circuits 28 for generating high frequency currents for the induction coils 16. The electronic circuits 28 are arranged below the induction coils 16.

In the circular hole in the centre of each induction coil 16 there is a light emitting diode 24. The light emitting diode 24 is fastened at the chassis 12 by a support element 26. The support element 26 has such a geometric structure, that only a little heat is transferred to the light emitting diode 24. Further, the support element 26 is made of a material with low heat conductivity. These properties of the support element 26 prevent a destruction of the light emitting diode 24.

In this example, only one light emitting diode 24 is arranged within the circular hole in the centre of each induction coil 16. In general, one or more light emitting diodes 24 may be arranged within the circular hole in the centre of the induction coil 16. Further, light emitting diodes 24 with different colours may be provided. Moreover, one or more RGB light emitting diodes 24 may be arranged within the circular hole.

FIG. 2 illustrates a schematic top view of the chassis 12 for the induction cooking hob with the sheet 20 according to the first embodiment of the present invention. The chassis 12 in FIG. 2 is the same as in FIG. 1, wherein additionally the sheet 20 is arranged on the upper side of the chassis 12.

In this example, the sheet 20 is a mica layer. In general, the sheet 20 is made of a dielectric material. The cut-outs 22 in the mica layer 20 are filled by a transparent dielectric material. In particular the cut-outs 22 in the mica layer 20 are filled by a foil made of polyimide. For example, the cut-outs 22 in the mica layer 20 are filled by Kapton®.

The sheet 20 comprises a plurality of cut-outs 22. In this example, the cut-outs 22 are formed as slots. There are four groups of eight cut-outs 22 in each case. The eight cut-outs 22 of each group form a star-shaped arrangement. Each group of cut-outs 22 corresponds with one of the heating zones 14.

FIG. 3 illustrates a schematic top view of the induction cooking hob with a panel 10 according to a second embodiment of the present invention. Preferably, the panel is a glass ceramic panel. The induction cooking hob of the second embodiment has the same structure as in the first embodiment. However, there are four groups of four cut-outs 22 in each case according to the second embodiment.

Additionally, the panel 10 is arranged on the chassis 12 in FIG. 3. The light from the light emitting diodes 24 radiates through the cut-outs 22 and through the panel 10, so that the heating zones 14 are illuminated. The user recognizes the positions of the heating zones 14 and the corresponding induction coils 16.

Further, the size of the cut-out 22 may indicate the size and/or the power of the corresponding heating zone 14 and inductions coil 16. This can be realized by a relative long cut-out 22 representing a big heating zone 14. In a similar way, a relative short cut-out 22 may represent a small heating zone 14.

Additionally, one or more ferrite elements may be arranged below the induction coils 16. For example, said ferrite elements have elongated forms and extend radially with respect to the induction coils 16.

Further, an outer light guide element may be arranged outside the induction coil 16 in order to indicate the size of said induction coil 16 and/or for design reasons. In this case, at least one connecting light guide element may be arranged between the light emitting diode 24 and said outer light guide. In a special case the outer light guide element has a circular form and encloses the induction coil 16. The at least one connecting light guide element may be arranged between the ferrite elements, for example.

FIG. 4 illustrates a sectional partial side view of the induction cooking hob according to a third embodiment of the present invention. FIG. 4 shows the panel 10 and the chassis 12 as the sectional partial side view.

The panel 10 is arranged above the chassis 12 and covers said chassis 12. At the lower side of the panel 10 a printed layer 18 is applied. The induction cooking hob of the third embodiment comprises no sheet 20, but the printed layer 18 at the lower side of the panel 10 has the same function as said sheet 20.

The printed layer 18 in the third embodiment has a similar pattern as the sheets 20 in the first and second embodiments. The printed layer 18 is obtained by applying a dark colour, preferably a black colour, at the lower side of the panel 10. The cut-outs 22 are realized by blank portions in the printed layer 18.

The chassis 12 comprises induction coils 16. One of the induction coils 16 is shown in FIG. 4. Further, the chassis 12 comprises electronic circuits 28 arranged below the induction coils 16. The electronic circuits 28 are provided for generating high frequency currents for the induction coils 16.

In the centre of the induction coil 16 there is a circular hole with the light emitting diode 24. The light emitting diode 24 is fastened at the chassis 12 by the support element 26. The support element 26 is formed in such a way, that only a little heat is transferred to the light emitting diode 24. The support element 26 is made of a material with low heat conductivity. These properties of the support element 26 prevent a destruction of the light emitting diode 24.

In particular, the support element 26 is an elongated and thin element extending horizontally within or below the circular hole of the induction coil 16. The support element 26 may be fastened below the circular hole of the induction coil 16 or below the induction coil 16 itself. The elongated support element 26 can be fastened either at its both ends or at one of its ends. In said first case the light emitting diode 24 may be attached at a central portion of the elongated support element 26. In said latter case the light emitting diode 24 may be attached at the other end of the elongated support element 26.

The light emitting diode 24 is cooled by an air stream. Said air stream may be a natural air stream and/or an air stream generated by at least one fan. Usually, the natural air stream and/or the fan are present in the cooking hob. When the light emitting diode 24 is not in a direct contact with the air stream, then the support element 26 is preferably made of metal, so that the thermal conductivity of the metal support element 26 can be used.

In the above examples the light source in the centre of the induction coil 16 is the light emitting diode 24. In general, also other light sources than light emitting diode 24 are suitable.

The present invention allows that the user can recognize the heating zones 14 by the light from the light emitting diode 24. The cost of materials is relative low. The induction cooking hob according to the present invention has a low complexity.

LIST OF REFERENCE NUMERALS

10 panel
12 chassis
14 heating zone
16 induction coil
18 printed layer
20 sheet
22 cut-out
24 light emitting diode
26 support element
28 electronic circuit
30 temperature sensor

The invention claimed is:

1. An induction cooking hob with illumination equipment, comprising:

a panel (10) arranged at the top side of said induction cooking hob and comprising at least one heating zone (14), a chassis (12) forming a substructure of said induction cooking hob, said chassis (12) comprising at least one induction coil (16) corresponding with the at least one heating zone and at least one light emitting diode (24) arranged in a central portion of the at least one induction coil (16), at least one intermediate layer (18, 20) between the panel (10) and the chassis (12), said intermediate layer (18, 20) comprising a plurality of cut-outs (22) arranged according to a predetermined pattern within the at least one heating zone (14), wherein at least one light emitting diode (24) corresponds with at least one cut-out (22), wherein light from the at least one light emitting diode (24) propagates through at least one of the cut-outs (22) arranged within the at least one heating zone (14) and through the panel (10) illuminating the at least one heating zone (14) in which the at least one light emitting diode (24) is arranged, and wherein the light emitting diode (24) is fastened at the chassis (12) by an elongated support element (26), which is also used to support a temperature sensor and which functions as an optical device and guides the light to the cut-outs (22).

2. The induction cooking hob according to claim 1, wherein the intermediate layer (18, 20) includes a non-transparent printed layer (18) applied at a lower side of the panel (10) and the non-transparent printed layer (18) allows the light from the at least one light emitting diode (24) to propagate through at least one of the cut-outs (22).

3. The induction cooking hob according to claim 2, wherein the printed layer (18) is a black colored layer.

4. The induction cooking hob according to claim 2, wherein the cut-outs (22) are formed as blank portions of the printed layer (18).

5. The induction cooking hob according to claim 1, wherein the intermediate layer (18, 20) includes a non-transparent sheet (20) arranged between the panel (10) and the chassis (12) and the non-transparent sheet (20) allows the light from the at least one light emitting diode (24) to propagate through at least one of the cut-outs (22).

6. The induction cooking hob according to claim 5, wherein the sheet (20) is made of at least one dielectric material.

7. The induction cooking hob according to claim 6, wherein the sheet (20) is or comprises a mica layer.

8. The induction cooking hob according to claim 1, wherein the cut-outs (22) in the layer (18, 20) are filled by a transparent dielectric material.

9. The induction cooking hob according to claim 1, wherein the cut-outs (22) in the intermediate layer (18, 20) are filled by a foil made of polyimide.

10. The induction cooking hob according to claim 1, wherein the support element (26) is made of a thermally insulating material, said support element (26) extending horizontally within or below the central portion of the at least one induction coil (16).

11. The induction cooking hob according to claim 1, wherein the cut-outs (22) are shaped as slots arranged according to a predetermined pattern.

12. The induction cooking hob according to claim 1, wherein the panel (10) is a glass ceramic panel (10).

13. The induction cooking hob according to claim 1, wherein the plurality of cut-outs (22), when viewed from a direction perpendicular to the panel (10), surround the at least one light emitting diode (24).

14. The induction cooking hob according to claim 1, wherein each of the plurality of cut-outs (22) extends radially from the central portion of the at least one induction coil (16) within which the at least one light emitting diode (24) is arranged toward a periphery of the at least one induction coil (16).

15. The induction cooking hob according to claim 1, wherein a length of each of the plurality of cut-outs (22) arranged within the at least one heating zone (14) indicates a size of the at least one heating zone (14).

* * * * *